US006189618B1

(12) United States Patent
Beeman et al.

(10) Patent No.: US 6,189,618 B1
(45) Date of Patent: Feb. 20, 2001

(54) WELLBORE WASH NOZZLE SYSTEM

(75) Inventors: Robert S. Beeman, Bossier City, LA (US); Mark Lee; Guy L. McClung, III, both of Spring, TX (US); Stephen P. Breaux, Lafayette, LA (US)

(73) Assignee: Weatherford/Lamb, Inc., Houston, TX (US)

( * ) Notice: Under 35 U.S.C. 154(b), the term of this patent shall be extended for 0 days.

(21) Appl. No.: 09/063,202

(22) Filed: Apr. 20, 1998

(Under 37 CFR 1.47)

(51) Int. Cl.[7] ..... E21B 21/10

(52) U.S. Cl. ..... 166/312; 166/194; 166/223

(58) Field of Search ..... 166/312, 100, 166/194, 154, 155, 169, 222, 223, 332.4, 334.4

(56) References Cited

U.S. PATENT DOCUMENTS

| | | | | |
|---|---|---|---|---|
| 1,661,672 | | 3/1928 | Morrison . | |
| 1,695,749 | | 12/1928 | Watson | 166/223 X |
| 1,715,767 | * | 6/1929 | Le Flore | 166/223 |
| 1,945,159 | | 1/1934 | Pearce . | |
| 1,945,160 | | 1/1934 | Pearce . | |
| 2,072,859 | | 3/1937 | Grant . | |
| 2,238,895 | | 4/1941 | Gage . | |
| 2,284,170 | | 5/1942 | Santiago . | |
| 2,680,486 | * | 6/1954 | Carpenter | 166/223 |
| 2,963,102 | | 12/1960 | Smith . | |
| 4,119,160 | | 10/1978 | Summers et al. | 175/67 |
| 4,574,894 | * | 3/1986 | Jadwin | 166/318 |
| 4,616,719 | | 10/1986 | Dismukes | 175/94 |
| 4,660,773 | | 4/1987 | O'Hanlon | 239/596 |
| 4,749,044 | * | 6/1988 | Skipper et al. | 166/312 |
| 4,768,709 | | 9/1988 | Yie | 239/8 |
| 4,787,465 | | 11/1988 | Dickinson, III et al. | 175/67 |
| 4,809,793 | | 3/1989 | Hailey | 175/265 |
| 4,919,204 | | 4/1990 | Baker et al. | 166/223 |
| 4,967,841 | | 11/1990 | Murray | 166/312 |
| 4,991,667 | | 2/1991 | Wilkes, Jr. et al. | 175/61 |
| 5,060,725 | | 10/1991 | Buell | 166/222 |
| 5,135,051 | | 8/1992 | Facteau et al. | 166/104 |
| 5,165,438 | | 11/1992 | Facteau et al. | 137/1 |
| 5,195,585 | | 3/1993 | Clemens et al. | 166/222 |
| 5,228,508 | | 7/1993 | Facteau et al. | 166/177 |
| 5,533,571 | | 7/1996 | Surjaatmadja et al. | 166/222 |

(List continued on next page.)

OTHER PUBLICATIONS

Hughes Tool Company Catalog, pp. 16, 17, 1965.
Brown Oil Tools, Perforation Wash Tool Composite Catalog p. 802, 1974–75.
"New Scale Removal Procedure Excels In Gulf of Mexico Wells," The American Oil & Gas Reporter, Jun. 98, pp. 106;108,198.
Int'l Search Report, PCT/GB99/01020 in PCT counterpart of this case.

*Primary Examiner*—William Neuder
(74) *Attorney, Agent, or Firm*—Guy McClung

(57) ABSTRACT

A wash nozzle for wellbore washing operations has been invented, the wash nozzle, in one aspect having a central mandrel with a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve from the exterior of the central mandrel to an exterior of the sleeve, the at least one sleeve port defined by a wall on the sleeve. In one aspect the wash nozzle includes apparatus for selective rotation of the sleeve about the mandrel. In one aspect flow through the wash nozzle is stopped to effect sleeve rotation and, in one particular aspect, flow through the nozzle is then re-established. Methods have been invented using such wash nozzles for wellbore washing operations and/or cuttings removal.

29 Claims, 3 Drawing Sheets

U.S. PATENT DOCUMENTS

| | | | | |
|---|---|---|---|---|
| 5,564,500 | * | 10/1996 | Rogers et al. | 166/318 |
| 5,697,442 | | 12/1997 | Baldridge | 166/286 |
| 5,769,164 | | 6/1998 | Archer | 166/222 |
| 5,797,454 | | 8/1998 | Hipp | 166/196 |
| 5,829,521 | | 11/1998 | Brown, Jr. | 166/173 |
| 5,829,539 | | 11/1998 | Newton et al. | 175/393 |
| 5,839,511 | | 11/1998 | Williams | 166/312 |
| 5,984,011 | * | 11/1999 | Misselbrook et al. | 166/312 |
| 6,065,541 | * | 5/2000 | Allen | 166/223 |

* cited by examiner

WELLBORE WASH NOZZLE SYSTEM

BACKGROUND OF THE INVENTION

1. Field of the Invention

This invention is directed to wellbore wash nozzles; to wellbore apparatuses and systems for facilitating the flow of cuttings from a wellbore mill, drill or mill-drill; in certain aspects, to milling, drilling, or milling-drilling systems with a wash nozzle; and to methods for using such nozzles and systems.

2. Description of Related Art

In wellbore milling, drilling, and milling-drilling operations cuttings are produced which, if not efficiently removed from the area around a mill, drill, or mill-drill, will inhibit or prevent effective operation. Typically such cuttings are removed by fluid pumped from the surface down through a work string, tubing string, or coiled tubing, through various apparatuses and devices, to the location of milling, drilling, or milling-drilling. In many prior art systems fluid is pumped through ports in a nozzle, mill, drill, or mill-drill. The pumped fluid moves the cuttings away from wellbore tools and up in an annulus in the wellbore.

In various wellbore operations, it is desirable to wash the interior of a tubular string. A variety of wash nozzles are used in prior art systems to accomplish this.

There has long been a need for an efficient and effective wash nozzle for washing tubulars' interiors and/or for cuttings removal, and for wellbore systems and methods with such a nozzle.

SUMMARY OF THE PRESENT INVENTION

The present invention, in certain aspects, discloses a wash nozzle having a central mandrel with a fluid flow bore therethrough from top to bottom. Initially a piston is sealingly and releasably secured within the fluid flow bore of the central mandrel, e.g. by one or more shear pins or shear screws. The piston also has a fluid flow bore therethrough from top to bottom so that when the piston's bore is not closed off, fluid is flowable through the mandrel.

A sleeve is sealingly and rotatably secured around and exteriorly of the central mandrel. The sleeve has one or more lower wash ports therethrough aligned with cut out areas on the interior of the sleeve and exterior of the central mandrel. The mandrel's lower wash ports are in fluid communication with the cut out areas and, in certain preferred embodiments, at the same level as the lower wash ports of the sleeve.

Initially, the piston blocks fluid flow through the lower wash ports of the central mandrel and, hence, through the lower wash ports of the sleeve. Upon dropping of a closure device (e.g. a dart, plug, or ball) into the piston to seat against a seat therein, thereby closing off flow through the piston and subjecting the shear pins(s) to the force of the fluid, the shear pins(s) shear freeing the piston. The piston moves down past the mandrel's lower wash ports so that fluid under pressure flows out from the sleeve's lower wash ports. In one aspect one or more of the lower wash ports are angled so that flow therethrough initiates and maintains sleeve rotation so that a rotating flow spray or wash impinges on a tubular and/or in a wellbore exteriorly of the nozzle. In one aspect the piston is deleted and the sleeve rotates continuously.

The central mandrel, in certain preferred embodiments, has one or more upper wash ports therethrough which are in fluid communication with a cut out area defined by a cut out portion of the exterior of the central mandrel and a cut out portion of the interior of the sleeve. One or more upper wash ports through the sleeve are also in fluid communication with the cut out area so that fluid flowing through the upper wash port(s) of the central mandrel flows out through the sleeve's upper wash ports into an annulus between the nozzle's exterior and the interior of a wellbore or of another tubular in which the nozzle is located. In one aspect there are multiple levels of upper wash ports in the sleeve and mandrel, with corresponding cut-out areas. In one aspect the piston is sized so that it does not block flow through the upper wash ports.

In one aspect one or more of the sleeve's lower wash ports is disposed at an angle so that fluid flowing into this wash port or ports of the sleeve's impinges on the port wall causing the sleeve to move and rotate around the central mandrel. Thus, in those embodiments with a piston (or other selectively operable structure) as described herein and one or more angled lower ports the sleeve is selectively rotatable. Prior to activation of sleeve rotation, flow occurs in those embodiments with one or more upper ports through the upper ports. In another aspect one or a set of upper ports and one or a set of lower ports are angled in different directions so little or no sleeve rotation occurs (until flow through one set of ports is blocked), since the ports are angled, sized, disposed and configured so that forces on the port walls offset each other, preventing or severely limiting sleeve rotation.

A wash nozzle according to the present invention may be used above or below any wellbore, mill, drill, or mill-drill. Such a nozzle may be used at any location in a wellbore coil tubing string. In one system according to the present invention, a connector connects the wash nozzle to a coiled tubing string which extends through a cased bore to the surface. A downhole motor is connected to and beneath the wash nozzle, and a cutting tool, e.g. a mill, drill, or mill-drill is connected to the downhole motor. Typically the top half of the motor does not rotate so the wash nozzle does not rotate in this particular embodiment. In other embodiments the entire wash nozzle may rotate with a tubular string. Initially, fluid pumped under pressure from the surface flows through the coiled tubing string, through the wash nozzle, and to the motor so that the motor rotates the cutting tool. At any desired point during or following the cutting operation, e.g., but not limited, upon cutting completion, a ball, plug, or dart is dropped to close off fluid flow through the piston and through the central mandrel. Fluid pressure shears the shear pins; the piston moves to unblock the fluid passage through the lower wash ports; sleeve rotation commences; and fluid flowing from the lower ports (and upper ports, if present) moves and lifts cuttings away from the cutting tool and its area of operation.

In one aspect the ball, plug, or dart is entirely made of washable, dissolvable, and/or disintegratable material so that, at a desired point, flow through and past the nozzle is reestablished. In one aspect the ball, plug, or dart has one or more channels therethrough or one or more recesses on a side thereof initially filled with washable material which, in response to flow at a known pressure and/or flow of a fluid known to wash away, dissolve, or eat away the washable material, flows away again providing a flow channel through the nozzle.

In one aspect the sleeve has one or more angled ports and is shear-pinned to the mandrel so that fluid pressure through the angled port breaks the pin freeing the sleeve for rotation. In one aspect a burst disc or burst tube (see e.g. burst tube and burst devices in U.S. application Ser. No. 08/992,620 filed Dec. 17, 1997 entitled "Wellbore Shoe Joints and Cementing Systems" co-owned with the present invention and incorporated fully herein for all purposes) initially blocks flow through the one or more angled ports. Also, a dart or plug with such a burst apparatus may be used so that flow through a nozzle is re-established.

In one aspect a nozzle according to the present invention has no piston as described above, but has at least one angled sleeve port in fluid communication with a mandrel port (and in one aspect a common fluid communicating cut-out area). A seat around a bore of the mandrel is positioned sufficiently below the at least one angled port that a closure device dropped into the nozzle seats against the seat, closing off flow through the nozzle, so that flow increases through the at least one angled port sufficiently to initiate sleeve rotation (or to increase sleeve rotation if fluid pressure prior to close off caused some sleeve rotation). Thus the mandrel bore can be sized as desired for any desired flow rate, without part of the bore blocked by a piston body, particularly in those specific embodiments in which a downhole motor powered by pumped fluid is run below the nozzle. In one such non-piston embodiment there is an upper set of one or more angled ports and a lower set of one or more ports angled oppositely to those of the upper set, so that, until closure device drop, the forces on the port(s) are opposite and the sleeve does not rotate or rotates minimally. The closure device is dropped to close off flow to the lower one or more angled ports, thus unbalancing forces on the sleeve and initiating sleeve rotation.

It is, therefore, an object of at least certain preferred embodiments of the present invention to provide:

- New, useful, unique, efficient, nonobvious wellbore wash nozzles and wellbore cutting systems with such a nozzle;
- Such a wash nozzle and/or cutting system therewith with apparatus for selectively flowing fluid through one or more wash ports;
- Such a wash nozzle and/or cutting system therewith having a sleeve rotatably mounted thereon, said sleeve rotatable in response to fluid flow through one or more wash ports through the sleeve;
- Such a wash nozzle with a sleeve that is selectively rotatable;
- Such a wash nozzle through which flow that has ceased is reestablished; and
- Method for using such wash nozzle and/or such cutting systems.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
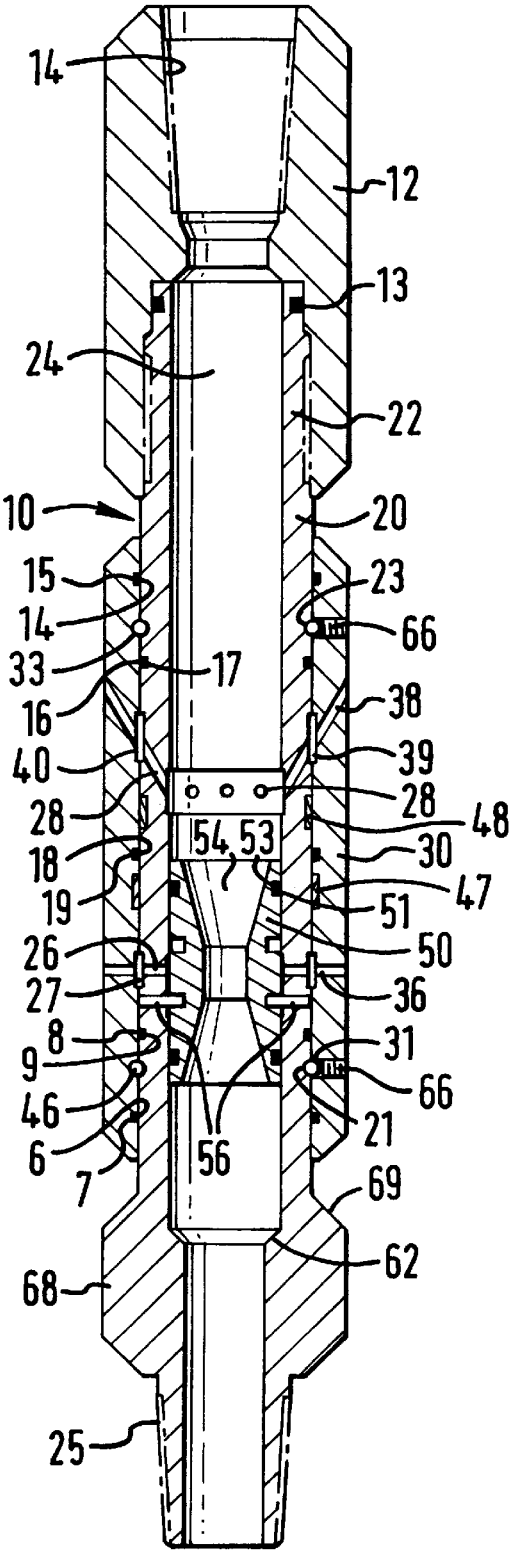
FIGS. 1 and 2A are side cross-section views of a wash nozzle according to the present invention.
Figure 2A:
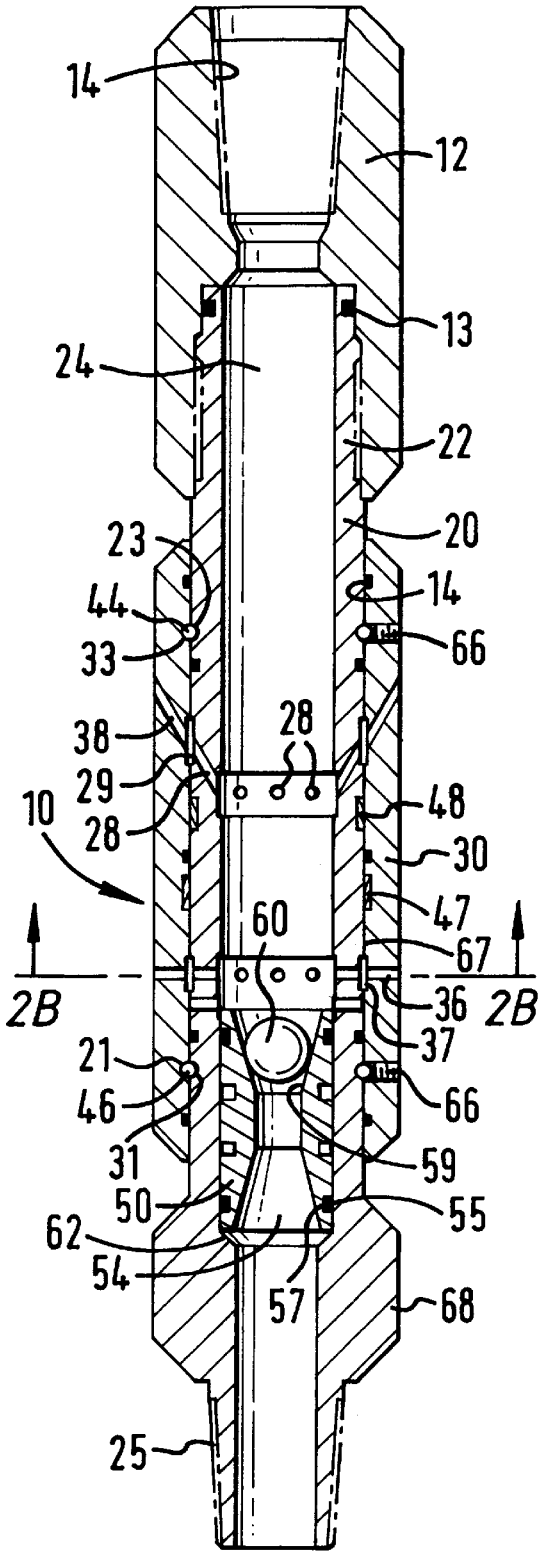

FIGS. 1 and 2A show a wash nozzle 10 according to the present invention with a central mandrel 20 having a top sub 12 threadedly connected to a top 22 of the central mandrel 20 and a sleeve 30 with a bore 67 therethrough rotatably mounted around the exterior of the central mandrel 20. The top sub 12 is connectible to any other suitable wellbore apparatus, device, tubular, or tubular string. In one aspect the top sub 12 is sized to act as a top stabilizer for the nozzle 10. Alternatively a stabilizer and/or centralizer is attached to or formed of the top and/or bottom of the mandrel 20.

Fluid pumped from the surface down a string to which the top sub 12 is connected flows through a fluid flow bore 14 through the top sub 12 and through a fluid flow bore 24 from the top 22 of the central mandrel 20 to and out through a bottom 25 of the central mandrel 20.

An O-ring 13 seals an interface between the interior of the top sub 12 and the exterior of the central mandrel 20. An O-ring 14 in a recess 15 in the sleeve 30 seals a sleeve/mandrel interface as does O-ring 16 in a recess 17 of the mandrel 20, O-ring 18 in a recess 19 of the sleeve 30, O-ring 8 in a recess 9 of the mandrel 20, and O-ring 6 in a recess 7 of the sleeve 30.

A plurality (eight in this embodiment) of upper wash ports 28 through the mandrel 20 are in fluid communication with a cut-out portion 29 of the mandrel 20 which, with a cut-out portion 39 of the sleeve 30 defines a cut-out area 40 which is in fluid communication with a plurality of upper wash ports 38 through the sleeve 30.

A plurality (eight in this embodiment) of lower wash ports 26 through the mandrel 20 are in fluid communication with a cut-out portion 27 of the mandrel 20 which, with a cut-out portion 37 of the sleeve 30 defines a cut-out area 42 which is in fluid communication with a plurality of lower wash ports 36 through the sleeve 30.

Rotation of the sleeve 30 with respect to the mandrel 20 is facilitated by a plurality of ball bearings 44 disposed in a raceway 23 in the mandrel 20 and a raceway 33 in the sleeve 30; and by a plurality of ball bearings 46 in a raceway 21 of the mandrel 20 and a raceway 31 of the sleeve 30. Removable plugs 66 provide access to the raceways and permit introduction of the bearings into the raceways and removal therefrom.

A piston 50 with a fluid flow bore 54 therethrough from top to bottom is initially sealingly and releasably held in the bore 24 of the mandrel 20 by shearable pins 56 (one, two, three, or more) which extend through the mandrel 20 into the piston 50. In one aspect the pins shear in response to a force between about 400 and 2200 pounds. In one aspect the pins are brass. In the position shown in FIG. 1, the piston 50 blocks fluid flow through the lower wash ports 26 of the mandrel 20.

An O-ring 51 in a recess 53 and an O-ring 55 in a recess 57 seal the piston/mandrel interface.

As shown in FIG. 2A, a ball 60 has been dropped into the piston 50 to sealingly abut a seat 59 of the piston 50 closing off fluid flow through the piston 50 and hence through the mandrel 20. Fluid pressure has sheared the pins 56, freeing the piston 50 for downward movement stopped by an inner shoulder 62 of the mandrel 20, thereby opening the lower wash ports 26 to fluid flow.

Figure 2B:
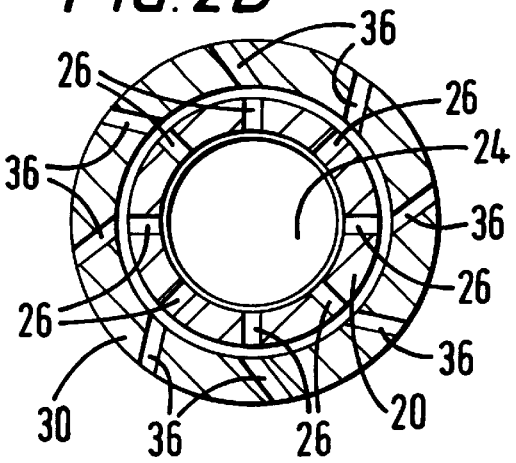
FIG. 2B is a view along line 2B—2B of FIG. 2A.

FIG. 2B shows one embodiment of a sleeve 30 with angled lower wash ports 36. Fluid flowing under pressure through the lower wash ports 26 of the mandrel 20 and through the cut-out area 42 impinges on the walls of the sleeve 30 defining its lower wash ports 36, causing the sleeve 30 to move and to rotate around the mandrel 20. Thus rotating fluid spray is produced both through the lower wash ports 36 and through the upper wash ports 38. Alternatively, the upper wash ports may be similarly angled instead of or in addition to the angling of the lower wash ports.

Figure 3:
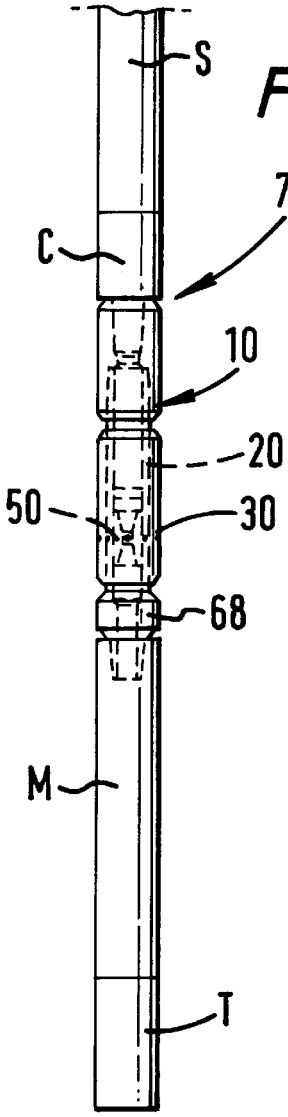
FIG. 3 is a side view, partially in cross-section, partially schematic, of a system according to the present invention.

FIG. 3 shows a system 70 according to the present invention with a wash nozzle 10 connected at the top to a connector C which itself is connected to a coil tubing string S that extends through a wellbore in the earth from the connector C to the surface. An optional downhole motor M is connected below the wash nozzle 10 and a cutting tool T (e.g. any suitable mill, bit, or mill-drill) is connected to and below the downhole motor M.

In one specific method of operation of the system 70, the downhole motor M is activated to perform a cutting operation (milling, drilling, and/or milling-drilling) which produces cuttings. Upon completion of the cutting operation, the ball 60 is dropped to seal against the seat 59. Following movement of the piston 50 (e.g. to a position as shown in FIG. 2A) fluid flows out through the lower wash ports 36 to move the cuttings and propel them upwardly to the surface. In one aspect such an operation including cutting (e.g. milling a window in a tubular and/or extending a bore in an earth formation) and washing is accomplished in a single trip into a wellbore.

In another embodiment the piston 50 is optional and is deleted so that fluid flow rotates the sleeve 30 at all times. In such an embodiment, one, some or all of the various ports are sized and angled so that desired rotation of the sleeve is achieved. A wash nozzle 10, with or without a piston 50, is movable through a tubular string (e.g. tubing, casing, pipe) to clean the interior thereof.

An enlarged portion 68 of the mandrel 20 acts as a centralizer or stabilizer.

Instead of or in addition to the bearings 44, 46, one or more bearing surfaces 48 may be provided on the exterior of the mandrel 20 and/or bearing surfaces 47 on the interior of the sleeve 30. The sleeve 30, when no bearings 44, 46 are used, can ride on shoulder 69 of the mandrel 20 with the cut-out areas 40, 42 sufficiently large to insure fluid flow therethrough; or the end of the sleeve 30 as shown in FIG. 1 is extended to contact the shoulder 69. The bearing surfaces 47 may be any desired length and may cover substantially all or a part of the inner surface of the sleeve 30; and the bearing surfaces 48 may be any desired length and may cover substantially all or a part of the exterior surface of the central mandrel 20 adjacent the sleeve 30.

Appropriately sized nozzles according to the present invention are useful for washing any enclosed member, including, but not limited to any wellbore tubular or string thereof (above or below ground, vertically, horizontally, or otherwise oriented), and any heat exchange member or tubular.

Figure 4A:
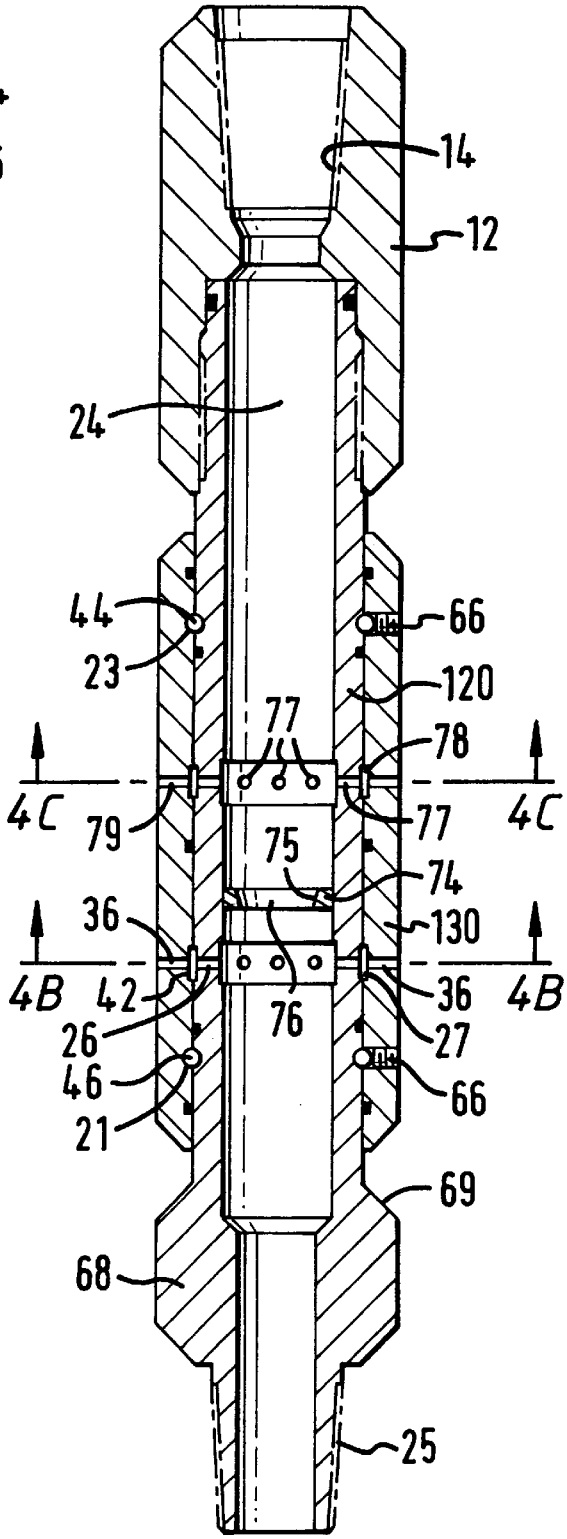
FIG. 4A shows a side cross-section views of a nozzle according to the present invention.

FIG. 4A discloses a wash nozzle 80 like the wash nozzle 10 in many respects and like numerals indicate like parts. A central mandrel 120 is like the central mandrel 20 of the wash nozzle 10, but the central mandrel 20 has no upper wash ports 28 or cut-out portion 29. A sleeve 130 is like the sleeve 30, but has no upper wash ports 38 or cut-out portion 39.

A seat member 74 with a seat 75 and a flow bore 76 therethrough is secured in the bore 24 of the mandrel 120. A closure device (e.g. any suitable prior art ball, plug, dart etc. or any device disclosed herein) seating against the seat 75 closes off flow through the bottom 25 of the mandrel 120. Fluid therefore is forced out mandrel ports 77, through a cut-out area 78, and then through upper sleeve ports 79. With the lower ports 26, 36 closed off to flow, flow through the upper sleeve ports 79 effects rotation of the sleeve 130.

Figure 4B:
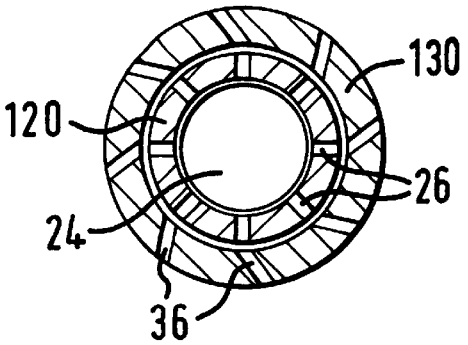
FIG. 4B is a cross-section view along line 4B—4B of FIG. 4A.
Figure 4C:
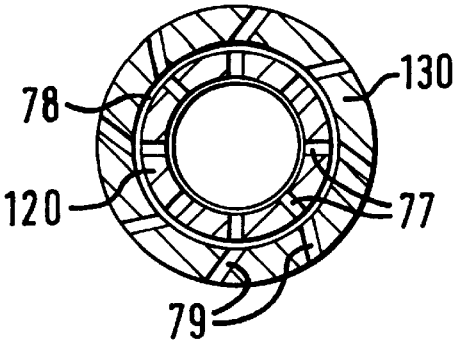
FIG. 4C is a cross-section view along line 4C—4C of FIG. 4A.

Ports in FIGS. 4A–4C and cut-out area 78 are shown schematically. Preferably, these items are sized and disposed so that, prior to entry and seating of a closure device on the seat 75, flow through the upper and lower sleeve ports produces counter balancing forces and the sleeve does not rotate or rotates only minimally. Following seating of a closure device in the seat 75, the lower sleeve ports are blocked to fluid flow and the fluid pressure of fluid flowing out the upper angled sleeve ports effects (and/or increases) sleeve rotation.

Figure 5:
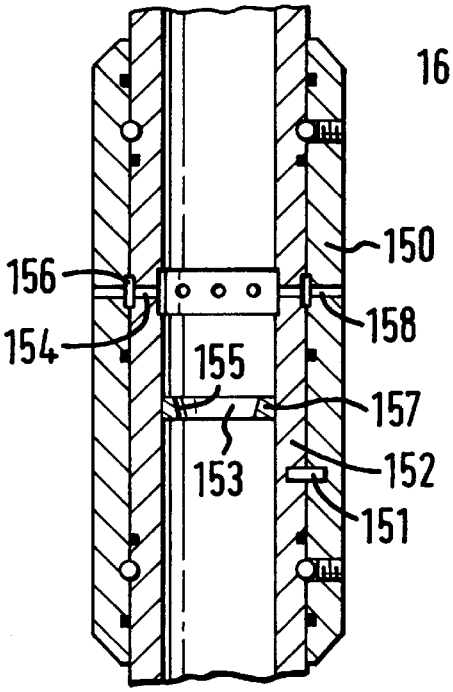
FIG. 5 is a side cross-section view of a nozzle according to the present invention.

FIG. 5 shows an alternative mandrel/sleeve combination for any embodiment described above. A sleeve 150 is rotatably mounted around a mandrel 152. Mandrel ports 154 are in fluid communication with a cut-out area 156 which is in fluid communication with sleeve ports 158. A seat member 157 with seat 155 and bore 153 performs as does the seat member in FIG. 4A. In one aspect the sleeve ports 158 are not angled with respect to the sleeve. In the embodiment shown, the ports resemble those of either FIG. 4B or 4C so that fluid at sufficient pressure flowing through the ports effects sleeve rotation. Optionally, an optional shear pin (or pins) 151 initially releasably secures the sleeve 150 to the mandrel 152. This pin(s) shears at a desired fluid pressure when one or more angled sleeve ports are used.

Figure 6A:
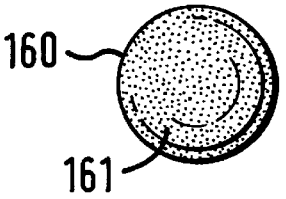
FIG. 6A is a top view of a ball according to the present invention for use with a nozzle according to the present invention.
Figure 6B:
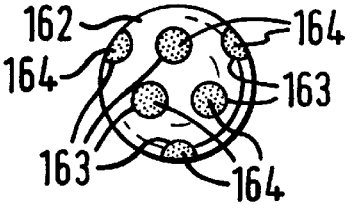
FIG. 6B is a top view of a ball according to the present invention for use with a nozzle according to the present invention.

FIG. 6A shows a ball closure device 160 made of washable, removable, or dissolvable material 161. FIG. 6B shows a ball closure device 162 with a series of channels 163 extending through the ball from one side to the other, each filled with washable or dissolvable material 164. Only one such channel may be used.

Figure 7A:
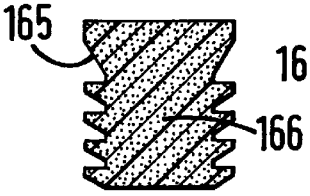
FIG. 7A is a side cross-section view of a plug according to the present invention for use with a nozzle according to the present invention.
Figure 7B:
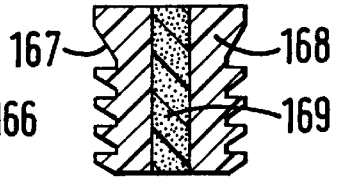
FIG. 7B is a side cross-section view of a plug according to the present invention for use with a nozzle according to the present invention.

FIG. 7A shows a plug closure device 165 made entirely of washable, removable, or dissolvable material 166. FIG. 7B shows a plug 167 with a central bore 168 initially filled with washable, removable, or dissolvable material 169. Additional bores with similar material may be used.

Figure 8:
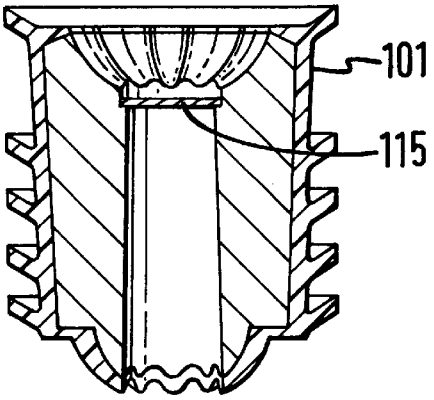
FIG. 8 is a side cross-section view of a prior art plug.

FIG. 8 shows a prior art plug 101 with a rupture disk 115 as described in U.S. Pat. No. 5,390,736 issued Feb. 21, 1995, co-owned with the present invention and incorporated fully herein for all purposes. A rupture disk or burst tube may be used in any of the channels of the devices of FIGS. 6A, 7B, and 9B.

Figure 9A:
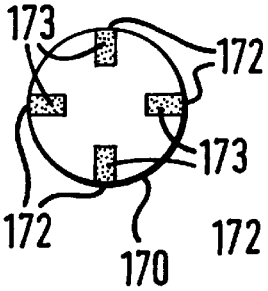
FIG. 9A is a top view of a plug according to the present invention.
Figure 9B:
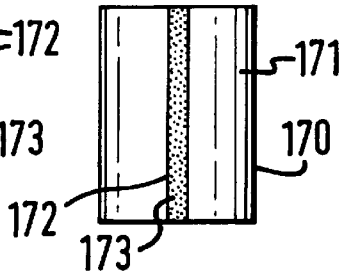
FIG. 9B is a side view of the plug of FIG. 9A.

FIG. 9A shows a plug 170 according to the present invention with a body 171 and portions 172 made of washable, removable, or dissolvable material 173.

Any of the closure devices of FIGS. 6A–9*a* may be used to close off a seat in a seat member used in nozzles according to the present invention.

It is within the scope of this invention for any embodiment hereof having one series of ports or two series of ports to have one, two or more additional series of ports above those already shown.

The present invention, therefore, in certain aspects, discloses a wash nozzle for wellbore washing operations and/or for tubular member cleaning operations, the wash nozzle having a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve from the exterior of the central mandrel to an exterior of the sleeve, the at least one sleeve port defined by a wall on the sleeve; such a wash nozzle wherein the at least one sleeve port is angled with respect to the sleeve so that fluid impinging on the wall defining the at least one sleeve port moves the sleeve to rotate about the central mandrel; such a wash nozzle wherein the at least one mandrel port is a plurality of lower mandrel ports, and the at least one sleeve port is a plurality of lower sleeve ports; any such wash nozzle with a lower cut-out area within the wash nozzle defined by a cut-out portion of the central mandrel and a cut-out portion of the sleeve, and the lower mandrel ports and the lower sleeve ports in fluid communication with the lower cut-out area; any such wash nozzle wherein the at least one mandrel port includes a plurality of upper mandrel ports spaced apart from the lower mandrel ports, and the at least one sleeve port includes a plurality of upper sleeve ports spaced apart from the lower sleeve ports; any such wash nozzle with an upper cut-out area within the wash nozzle defined by a cut-out portion of the central mandrel and a cut-out portion of the sleeve, and the upper mandrel ports and the upper sleeve ports in fluid communication with the upper cut-out area; any such wash nozzle with a piston having a top, a bottom, and a fluid flow bore therethrough from top to bottom, at least one shearable member releasably securing the piston to and within the central mandrel, and a portion of the piston initially blocking fluid flow through the lower mandrel ports; any such wash nozzle wherein the piston is configured and sized so that upon shearing of the at least one shearable member the piston is movable within the central mandrel's fluid flow bore to a position at which the piston does not block fluid flow into the lower mandrel ports; any such wash nozzle wherein the piston has an internal seat closable by a closure device dropped into the piston's fluid flow bore to shut off fluid flow through the piston; any such wash nozzle including a closure device shutting off fluid flow through the piston; any such wash nozzle wherein the closure device has at least a portion thereof made of removable material whose removal re-establishes fluid flow through the piston; any such wash nozzle wherein the closure device is substantially all made of removable material; any such wash nozzle wherein the removable material is shear-pinned with at least one shear pin to the closure device and shearing of the at least one shear pin frees the removable material; any such wash nozzle wherein the closure device has at least a portion thereof made of dissolvable material whose dissolution re-establishes fluid flow through the piston; any such wash nozzle wherein the closure device is substantially all dissolvable material; any such wash nozzle with bearing apparatus between the sleeve and the central mandrel to facilitate sleeve rotation; any such wash nozzle wherein the bearing apparatus includes a plurality of ball bearings in at least one raceway between the central mandrel and the sleeve; any such wash nozzle wherein the at least one raceway is at least two raceways each with a plurality of ball bearings therein; any such wash nozzle wherein the bearing apparatus is a bearing surface on an interior of the sleeve; any such wash nozzle wherein the bearing apparatus is a bearing surface on an exterior of the central mandrel; any such wash nozzle with a stabilizer member at a lower end of the central mandrel, and a stabilizer member at the top of the central mandrel; any such wash nozzle with apparatus for selective rotation of the sleeve about the mandrel.

The present invention discloses, in certain aspects, a wash nozzle for wellbore washing operations, the wash nozzle having a central mandrel having a top, a bottom, and a fluid flow bore therethrough from top to bottom, a plurality of spaced-apart upper and lower mandrel ports through the central mandrel for fluid flow from within the central mandrel's fluid flow bore to an exterior of the central mandrel, a hollow sleeve rotatably mounted around the central mandrel, a plurality of spaced-apart upper and lower sleeve ports through the sleeve for fluid flow from within the sleeve to an exterior of the sleeve, each lower sleeve port defined by a wall of the sleeve and angled with respect to the sleeve so that fluid impinging on the wall defining each lower sleeve port moves the sleeve to rotate about the central mandrel, a lower cut-out area within the wash nozzle defined by a cut-out portion of the central mandrel and a cut-out portion of the sleeve, the lower mandrel ports and the lower sleeve ports in fluid communication with the lower cut-out area, an upper cut-out area within the wash nozzle defined by a cut-out portion of the central mandrel and a cut-out portion of the sleeve, the upper mandrel ports and the upper sleeve ports in fluid communication with the upper cut-out area, a piston having a top, a bottom, and a fluid flow bore therethrough from top to bottom, at least one shearable member releasably securing the piston to and within the central mandrel, a portion of the piston initially blocking fluid flow through the lower mandrel ports, and the piston configured and sized so that upon shearing of the at least one shearable member the piston is movable within the central mandrel's fluid flow bore to a position at which the piston does not block fluid flow into the lower mandrel ports so that fluid flows from the central mandrel, through the lower mandrel ports, through the lower cut out area and through the lower sleeve ports to rotate the sleeve effecting rotative fluid flow from the wash nozzle.

The present invention discloses, in certain aspects, a wash nozzle as described above with a plurality of upper and lower sleeve and mandrel ports wherein the plurality of lower sleeve ports includes at least one angled lower sleeve port angled in a first direction with respect to the sleeve so that fluid from the central mandrel impinging on a wall defining the at least one angled lower sleeve port forces the sleeve to rotate in a first direction, the plurality of upper sleeve ports includes at least one angled upper sleeve port angled in a second direction with respect to the sleeve so that fluid from the central mandrel impinging on a wall defining the at least one angled upper sleeve port forces the sleeve to rotate in a second direction opposite to the first direction, and said forces on the sleeve counteracting each other to inhibit sleeve rotation; any such wash nozzle wherein the forces on the sleeve prevent sleeve rotation; any such wash nozzle wherein the at least one angled lower sleeve port is a plurality of angled lower sleeve ports, the at least one angled upper sleeve port is a plurality of angled upper sleeve ports, and forces on the upper and lower angled sleeve ports counteract each other to inhibit sleeve rotation; any such wash nozzle with a seat around the fluid flow bore through the central mandrel, the seat disposed so that a closure device on the seat blocks fluid flow to the at least one angled lower sleeve port and so that flow to the at least one angled upper sleeve port is not blocked, effecting rotation of the sleeve; any such wash nozzle including a closure device on the seat; and any such wash nozzle wherein the closure device has means for re-establishing fluid flow through the wash nozzle.

The present invention, in certain aspects, discloses a wellbore system with a wash nozzle with a top and a bottom and comprising a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve to an exterior of the sleeve, the at least one sleeve port defined by a wall on the sleeve; a downhole motor or "mud motor" operatively connected to the bottom of the wash nozzle and in fluid communication therewith; a wellbore cutting tool (e.g. reamer, drill, mill, or mill-drill) operatively connected to and beneath the downhole motor, and a tubular string (tubulars, coil tubing, etc.) connected to and above the wash nozzle and in fluid communication therewith.

The present invention discloses, in certain aspects, a method for cleaning a tubular (at the surface or in an earth wellbore), the method including locating a wash nozzle (any as disclosed herein) adjacent a tubular to be cleaned; and flowing fluid through the wash nozzle to clean an interior of the tubular.

The present invention discloses, in certain aspects, a method for removing cuttings from a wellbore, the method including introducing a wellbore system into the wellbore containing cuttings, the wellbore system having a wash nozzle (any as disclosed herein) a downhole motor operatively connected to the bottom of the wash nozzle and in fluid communication therewith, a wellbore cutting tool (e.g. any reamer, mill, mill-drill, or drill) operatively connected to and beneath the downhole motor, and a tubular string connected to and above the wash nozzle and in fluid communication therewith; rotating the wellbore cutting tool with the downhole motor, producing wellbore cuttings; and flowing fluid through the at least one mandrel port and through the at least one sleeve port into a space exterior to the wash nozzle to facilitate removal of the cuttings from the wellbore.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A wash nozzle for wellbore washing operations, the wash nozzle comprising a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve from the exterior of the central mandrel to an exterior of the sleeve, the at least one mandrel port is a plurality of lower mandrel ports, and the at least one sleeve port is a plurality of lower sleeve ports, a plurality of upper mandrel ports spaced apart from the lower mandrel ports, and a plurality of upper sleeve ports spaced apart from the lower sleeve ports, an upper cut-out area within the wash nozzle defined by a cut-out portion of the central mandrel and a cut-out portion of the sleeve, the upper mandrel ports and the upper sleeve ports in fluid communication with the upper cut-out area, and a piston having a top, a bottom, and a fluid flow bore therethrough from top to bottom, at least one shearable member releasably securing the piston to and within the central mandrel, and a portion of the piston initially blocking fluid flow through the lower mandrel ports.

2. The wash nozzle of claim 1 wherein the at least one sleeve port is angled with respect to the sleeve so that fluid impinging on the wall defining the at least one sleeve port moves the sleeve to rotate about the central mandrel.

3. The wash nozzle of claim 1 wherein the at least one mandrel port is a plurality of lower mandrel ports, and the at least one sleeve port is a plurality of lower sleeve ports.

4. The wash nozzle of claim 2 further comprising a lower cut-out area within the wash nozzle defined by a cut-out portion of the central mandrel and a cut-out portion of the sleeve, and the lower mandrel ports and the lower sleeve ports in fluid communication with the lower cut-out area.

5. The wash nozzle of claim 1 wherein the piston is configured and sized so that upon shearing of the at least one shearable member the piston is movable within the central mandrel's fluid flow bore to a position at which the piston does not block fluid flow into the lower mandrel ports.

6. The wash nozzle of claim 1 wherein the piston has an internal seat closable by a closure device dropped into the piston's fluid flow bore to shut off fluid flow through the piston.

7. The wash nozzle of claim 6 including a closure device shutting off fluid flow through the piston.

8. The wash nozzle of claim 7 wherein the closure device has at least a portion thereof made of removable material whose removal re-establishes fluid flow through the piston.

9. The wash nozzle of claim 8 wherein the closure device is substantially all made of removable material.

10. The wash nozzle of claim 7 wherein the closure device has at least a portion thereof made of dissolvable material whose dissolution re-establishes fluid flow through the piston.

11. The wash nozzle of claim 10 wherein the closure device is substantially all dissolvable material.

12. The wash nozzle of claim 1 further comprising bearing apparatus between the sleeve and the central mandrel to facilitate sleeve rotation.

13. The wash nozzle of claim 12 wherein the bearing apparatus includes a plurality of ball bearings in at least one raceway between the central mandrel and the sleeve.

14. The wash nozzle of claim 13 wherein the at least one raceway is at least two raceways each with a plurality of ball bearings therein.

15. The wash nozzle of claim 12 wherein the bearing apparatus is a bearing surface on an interior of the sleeve.

16. The wash nozzle of claim 12 wherein the bearing apparatus is a bearing surface on an exterior of the central mandrel.

17. The wash nozzle of claim 1 further comprising apparatus for selective rotation of the sleeve about the mandrel.

18. A wash nozzle for wellbore washing operations, the wash nozzle comprising a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve from the exterior of the central mandrel to an exterior of the sleeve, and a stabilizer member at a lower end of the central mandrel, and a stabilizer member at the top of the central mandrel.

19. The wash nozzle of claim 18 further comprising apparatus for selective rotation of the sleeve about the mandrel.

20. A wash nozzle for wellbore washing operations, the wash nozzle comprising a central mandrel having a top, a bottom, and a fluid flow bore therethrough from top to bottom, a plurality of spaced-apart upper and lower mandrel ports through the central mandrel for fluid flow from within the central mandrel's fluid flow bore to an exterior of the central mandrel, a hollow sleeve rotatably mounted around the central mandrel, and a plurality of spaced-apart upper and lower sleeve ports through the sleeve for fluid flow from within the sleeve to an exterior of the sleeve, each lower sleeve port angled with respect to the sleeve so that fluid impinging on the wall defining each lower sleeve port moves the sleeve to rotate about the central mandrel, a lower cut-out area within the wash nozzle defined by a cut-out portion of the central mandrel and a cut-out portion of the sleeve, the lower mandrel ports and the lower sleeve ports in fluid communication with the lower cut-out area, an upper cut-out area within the wash nozzle defined by a cut-out portion of the central mandrel and a cut-out portion of the sleeve, the upper mandrel ports and the upper sleeve ports in fluid communication with the upper cut-out area, a piston having a top, a bottom, and a fluid flow bore therethrough from top to bottom, at least one shearable member releasably securing the piston to and within the central mandrel, a portion of the piston initially blocking fluid flow through the lower mandrel ports, and the piston configured and sized so that upon shearing of the at least one shearable member the piston is movable within the central mandrel's fluid flow bore to a position at which the piston does not block fluid flow into the lower mandrel ports so that fluid flows from the central mandrel, through the lower mandrel ports, through the lower cut out area and through the lower sleeve ports to rotate the sleeve effecting rotative fluid flow from the wash nozzle.

21. A wash nozzle for wellbore washing operations, the wash nozzle comprising a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve from the exterior of the central mandrel to an exterior of the sleeve, a stabilizer member at a lower end of the central mandrel, and a stabilizer member at the top of the central mandrel, the at least one mandrel port is a plurality of lower mandrel ports, and, the at least one sleeve port is a plurality of lower sleeve ports, the at least one mandrel port includes a plurality of upper mandrel ports spaced apart from the lower mandrel ports, and the at least one sleeve port includes a plurality of upper sleeve ports spaced apart from the lower sleeve ports, the plurality of lower sleeve ports including at least one angled lower sleeve port angled in a first direction with respect to the sleeve so that fluid from the central mandrel impinging on a wall defining the at least one angled lower sleeve port forces the sleeve to rotate in a first direction, the plurality of upper sleeve ports including at least one angled upper sleeve port angled in a second direction with respect to the sleeve so that fluid from the central mandrel impinging on a wall defining the at least one angled upper sleeve port forces the sleeve to rotate in a second direction opposite to the first direction, and said forces on the sleeve counteracting each other to inhibit sleeve rotation.

22. The wash nozzle of claim 21 wherein the forces on the sleeve prevent sleeve rotation.

23. The wash nozzle of claim 21 wherein the at least one angled lower sleeve port is a plurality of angled lower sleeve ports, the at least one angled upper sleeve port is a plurality of angled upper sleeve ports, and forces on the upper and lower angled sleeve ports counteract each other to inhibit sleeve rotation.

24. The wash nozzle of claim 4 further comprising a seat around the fluid flow bore through the central mandrel, the seat disposed so that a closure device on the seat blocks fluid flow to the at least one angled lower sleeve port and so that flow to the at least one angled upper sleeve port is not blocked, effecting rotation of the sleeve.

25. The wash nozzle of claim 24 including a closure device on the seat.

26. The wash nozzle of claim 25 wherein the closure device has means for re-establishing fluid flow through the wash nozzle.

27. A wellbore system comprising a wash nozzle with a top and a bottom and comprising a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve to an exterior of the sleeve, the at least one mandrel port is a plurality of lower mandrel ports, and the at least one sleeve port is a plurality of lower sleeve ports, a plurality of upper mandrel ports spaced apart from the lower mandrel ports, and a plurality of upper sleeve ports spaced apart from the lower sleeve ports, an upper cut-out area within the wash nozzle defined by a cut-out portion of the central mandrel and a cut-out portion of the sleeve, the upper mandrel ports and the upper sleeve ports in fluid communication with the upper cut-out area, and a piston having a top, a bottom, and a fluid flow bore therethrough from top to bottom, at least one shearable member releasably securing the piston to and within the central mandrel, and a portion of the piston initially blocking fluid flow through the lower mandrel ports, a downhole motor operatively connected to the bottom of the wash nozzle and in fluid communication therewith, a wellbore cutting tool operatively connected to and beneath the downhole motor, and a tubular string connected to and above the wash nozzle and in fluid communication therewith.

28. A method for cleaning a tubular in an earth wellbore, the method comprising locating a wash nozzle adjacent a tubular to be cleaned, the wash nozzle comprising a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve to an exterior of the sleeve, the at least one mandrel port is a plurality of lower mandrel ports, and the at least one sleeve port is a plurality of lower sleeve ports, a plurality of upper mandrel ports spaced apart from the lower mandrel ports, and a plurality of upper sleeve ports spaced apart from the lower sleeve ports, an upper cut-out area within the wash nozzle defined by a cut-out portion of the central mandrel and a cut-out portion of the sleeve, the upper mandrel ports and the upper sleeve ports in fluid communication with the upper cut-out area, and a piston having a top, a bottom, and a fluid flow bore therethrough from top to bottom, at least one shearable member releasably securing the piston to and within the central mandrel, and a portion of the piston initially blocking fluid flow through the lower mandrel ports, and flowing fluid through the wash nozzle to clean an interior of the tubular.

29. A method for removing cuttings from a wellbore, the method comprising introducing a wellbore system into the wellbore containing cuttings, the wellbore system comprising a wash nozzle comprising a central mandrel having a top, a bottom, and a fluid flow bore therethrough from top to bottom, at least one mandrel port through the central mandrel for fluid flow from within the central mandrel's fluid flow bore to an exterior of the central mandrel, a hollow sleeve rotatably mounted around the central mandrel, and at least one sleeve port through the sleeve for fluid flow from within the sleeve to an exterior of the sleeve, the at least one mandrel port is a plurality of lower mandrel ports, and the at least one sleeve port is a plurality of lower sleeve ports, a plurality of upper mandrel ports spaced apart from the lower mandrel ports, and a plurality of upper sleeve ports spaced apart from the lower sleeve ports, an upper cut-out area within the wash nozzle defined by a cut-out portion of the central mandrel and a cut-out portion of the sleeve, the upper mandrel ports and the upper sleeve ports in fluid communication with the upper cut-out area, and a piston having a top, a bottom, and a fluid flow bore therethrough from top to bottom, at least one shearable member releasably securing the piston to and within the central mandrel, and a portion of the piston initially blocking fluid flow through the lower mandrel ports, a downhole motor operatively connected to the bottom of the wash nozzle and in fluid communication therewith, a wellbore cutting tool operatively connected to and beneath the downhole motor, and a tubular string connected to and above the wash nozzle and in fluid communication therewith, rotating the wellbore cutting tool with the downhole motor, producing wellbore cuttings, and flowing fluid through the at least one mandrel port and through the at least one sleeve port into a space exterior to the wash nozzle to facilitate the cuttings from the wellbore.

* * * * *